US008100784B2

(12) United States Patent
Conforti et al.

(10) Patent No.: US 8,100,784 B2
(45) Date of Patent: Jan. 24, 2012

(54) LACROSSE GOAL EXTENSION NET

(76) Inventors: Harry Conforti, Andover, MA (US); Ray Cozzi, Reading, MA (US); James Brooks Sweet, Hempstead, NY (US)

( * ) Notice: Subject to any disclaimer, the term of this patent is extended or adjusted under 35 U.S.C. 154(b) by 227 days.

(21) Appl. No.: 12/479,533

(22) Filed: Jun. 5, 2009

(65) Prior Publication Data

US 2010/0120558 A1 May 13, 2010

Related U.S. Application Data

(60) Provisional application No. 61/059,236, filed on Jun. 5, 2008, provisional application No. 61/145,062, filed on Jan. 15, 2009.

(51) Int. Cl.
*A63B 71/00* (2006.01)

(52) U.S. Cl. ..... 473/478; 273/400

(58) Field of Classification Search ..... 473/478, 473/472, 421; D21/704, 705, 706; 273/400, 273/407; 256/26, 11, 72; 119/514
See application file for complete search history.

(56) References Cited

U.S. PATENT DOCUMENTS

| | | | | |
|---|---|---|---|---|
| 1,591,753 | A * | 7/1926 | Flaugh | 473/421 |
| 3,017,183 | A * | 1/1962 | Chalcroft | 473/483 |
| 4,819,582 | A * | 4/1989 | Lichvar | 119/474 |
| 5,054,791 | A | 10/1991 | Ball | |
| 5,205,564 | A | 4/1993 | Lamberti et al. | |
| 5,277,430 | A | 1/1994 | Naccarato | |
| 5,564,711 | A | 10/1996 | Scheie | |
| 6,083,124 | A | 7/2000 | Williams | |
| 6,261,196 | B1 | 7/2001 | Caruso | |
| 6,287,220 | B1 | 9/2001 | Caruso | |
| 6,308,468 | B1 | 10/2001 | Caruso | |
| 6,849,009 | B1 * | 2/2005 | Forlini | 473/446 |
| 6,899,645 | B1 * | 5/2005 | Hsiao | 473/446 |
| 7,241,235 | B2 | 7/2007 | Caruso | |
| 7,244,199 | B1 | 7/2007 | Romano | |
| 7,300,059 | B2 | 11/2007 | Caruso | |
| 7,341,531 | B2 | 3/2008 | Caruso | |
| 7,351,168 | B1 | 4/2008 | Pannell | |
| 2006/0293126 | A1 * | 12/2006 | Thomas et al. | 473/481 |
| 2007/0142130 | A1 | 6/2007 | Caruso | |
| 2007/0144081 | A1 | 6/2007 | Caruso | |
| 2007/0158913 | A1 | 7/2007 | Rigoli | |
| 2009/0029804 | A1 * | 1/2009 | Crawley et al. | 473/432 |
| 2009/0209372 | A1 * | 8/2009 | Rigoli | 473/435 |

FOREIGN PATENT DOCUMENTS

| | | |
|---|---|---|
| CA | 2 568 082 | 5/2008 |

* cited by examiner

*Primary Examiner* — Gene Kim
*Assistant Examiner* — M Chambers
(74) *Attorney, Agent, or Firm* — Knobbe, Martens, Olson & Bear, LLP

(57) ABSTRACT

An extension net for providing a backstop for a standard or specially modified lacrosse goal. The extension net includes one or more frame portions that are secured to the lacrosse goal and are rotatable so as to vary an angle between an end portion of the extension net and the lacrosse goal. The extension net can be sized so as to mark an outer boundary of a regulation lacrosse crease.

14 Claims, 20 Drawing Sheets

LACROSSE GOAL EXTENSION NET

CROSS-REFERENCE TO RELATED APPLICATIONS

This application is related to, and claims the benefit of U.S. Provisional Patent Application No. 61/059,236, filed Jun. 5, 2008, and U.S. Provisional Patent Application No. 61/145,062, filed Jan. 15, 2009, the entireties of which are hereby incorporated by reference herein and made a part of the present specification.

BACKGROUND OF THE INVENTION

1. Field of the Invention

The present invention relates to a device that attaches to a standard or specially-modified lacrosse goal to provide a backstop for stopping errant shot attempts.

2. Description of the Related Art

Lacrosse is a full contact sport played using a small solid rubber ball and long handled racket called a crosse or lacrosse stick. The head of the crosse has a loose net strung into it that allows the player to hold the ball. Offensively the object of the game is to use the stick to catch, carry, and pass the ball in an effort to score by ultimately throwing the ball into an opponent's goal. A standard lacrosse goal measures six feet across and six feet high and contains a mesh netting, similar to an ice hockey goal. The goal sits inside a circular "crease" that measures 18 feet in diameter. During a game, offensive players are not allowed to enter the crease at any time.

A problem that arises when practicing lacrosse shots is that errant shots may travel long distances beyond the goal. Typical lacrosse shots may reach speeds in the 70 mile per hour range and the shot speed of a top professional may exceed 100 miles per hour. Thus, an errant practice shot can pose a safety risk to surrounding people and property. Additionally, a player may have to walk a long distance to retrieve a missed shot or have difficulty locating the ball, thus interrupting his or her practice session. Therefore there is a need for an extension net that can be used with a conventional lacrosse goal to stop missed shots.

SUMMARY OF THE INVENTION

In one embodiment, a lacrosse goal extension system includes a lacrosse goal and a lacrosse goal extension net. The lacrosse goal includes first and second upright goal supports, the first upright goal support defining a first opening and the second upright goal support defining a second opening. The lacrosse goal extension net includes first and second upright net supports configured to be received within a respective one of the first and second openings defined by the first and second upright goal supports, first and second side arms, a central bar connected to the first and second side arms via first and second articulated elbow joints, the first and second articulated elbow joints allowing first and second sides of the lacrosse goal extension net to be rotatably adjusted relative to the central bar, and a mesh netting supported at least by the first and second side arms and by the central bar. The first and second upright net supports extend outwardly from the first and second upright net supports and connect to the first and second side arms at a medial location on the first and second side arms.

In one embodiment, a lacrosse goal extension net includes a frame including left and right frame portions configured to attach to respective left and right portions of an associated lacrosse goal and be supported thereby in a cantilevered manner, each of the left and right frame portions extending upward and outward from the lacrosse goal, and a mesh net supported by the frame, wherein each of the left and right frame portions are rotatably adjustable to vary an angle between the left and right frame portions and the lacrosse goal.

In one embodiment, a sport goal extension system includes a sport goal and a sport goal extension net. The sport goal includes first and second upright goal supports, the first upright goal support defining a first opening and the second upright goal support defining a second opening. The sport goal extension net includes first and second upright net supports configured to be received within a respective one of the first and second openings defined by the first and second upright goal supports, first and second side arms, a central bar connected to the first and second side arms via first and second articulated elbow joints, the first and second articulated elbow joints allowing first and second sides of the sport goal extension net to be rotatably adjusted relative to the central bar, and a mesh netting supported at least by the first and second side arms and by the central bar. The first and second upright net supports extend outwardly from the first and second upright net supports and connect to the first and second side arms at a medial location on the first and second side arms.

In one embodiment, a sport goal extension net includes a frame including left and right frame portions configured to attach to respective left and right portions of an associated sport goal and be supported thereby in a cantilevered manner, each of the left and right frame portions extending upward and outward from the sport goal, and a mesh net supported by the frame, wherein each of the left and right frame portions are rotatably adjustable to vary an angle between the left and right frame portions and the sport goal.

In one embodiment, a hockey attachment net includes a netting having a plurality of connectors disposed on top and side portions, the connectors being configured to secure the netting to the face of a lacrosse goal, the netting being appropriately dimensioned so as to reduce the effective shooting area of the goal to hockey dimensions.

BRIEF DESCRIPTION OF THE DRAWINGS

These and other features, aspects and advantages of the invention will now be described with reference to its diversity of certain preferred embodiments, which are entered to illustrate and not limit the invention, and in which.

DETAILED DESCRIPTION OF THE PREFERRED EMBODIMENTS

Figure 1B:
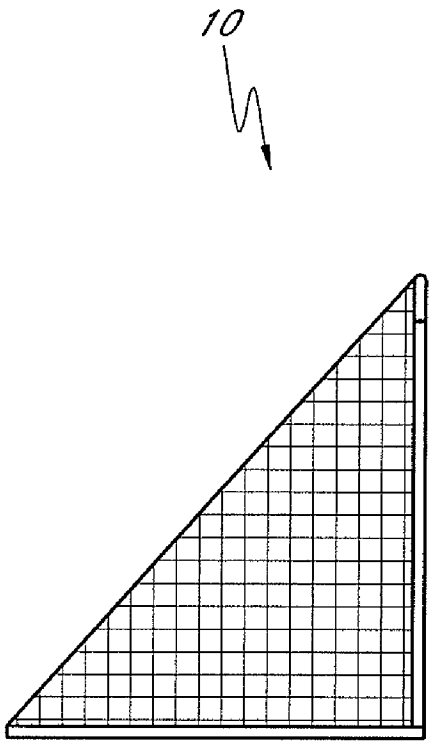
FIG. 1B is a side view of the standard lacrosse goal of FIG. 1A.
Figure 1A:
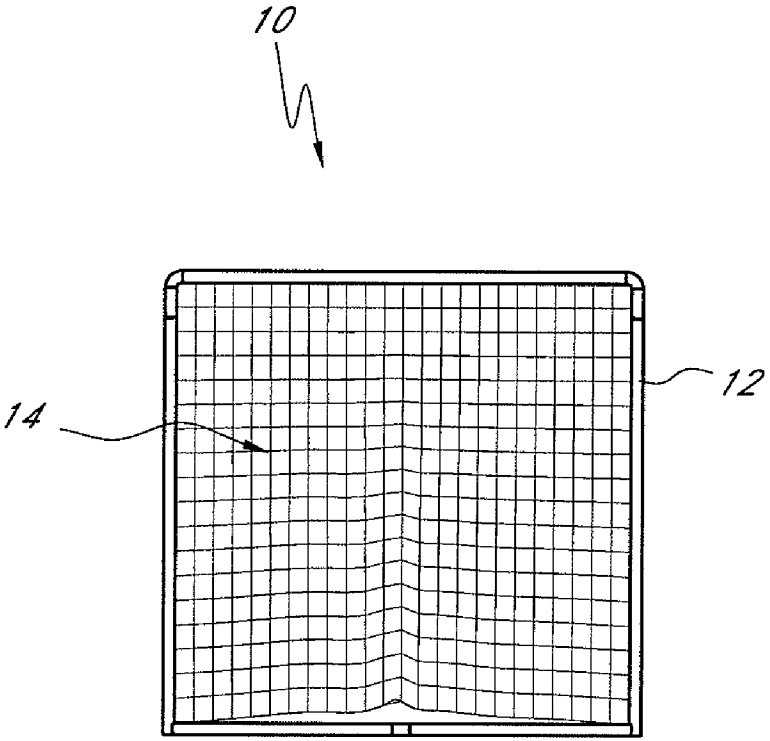
FIG. 1A is a front view of a standard lacrosse goal.
Figure 1C:
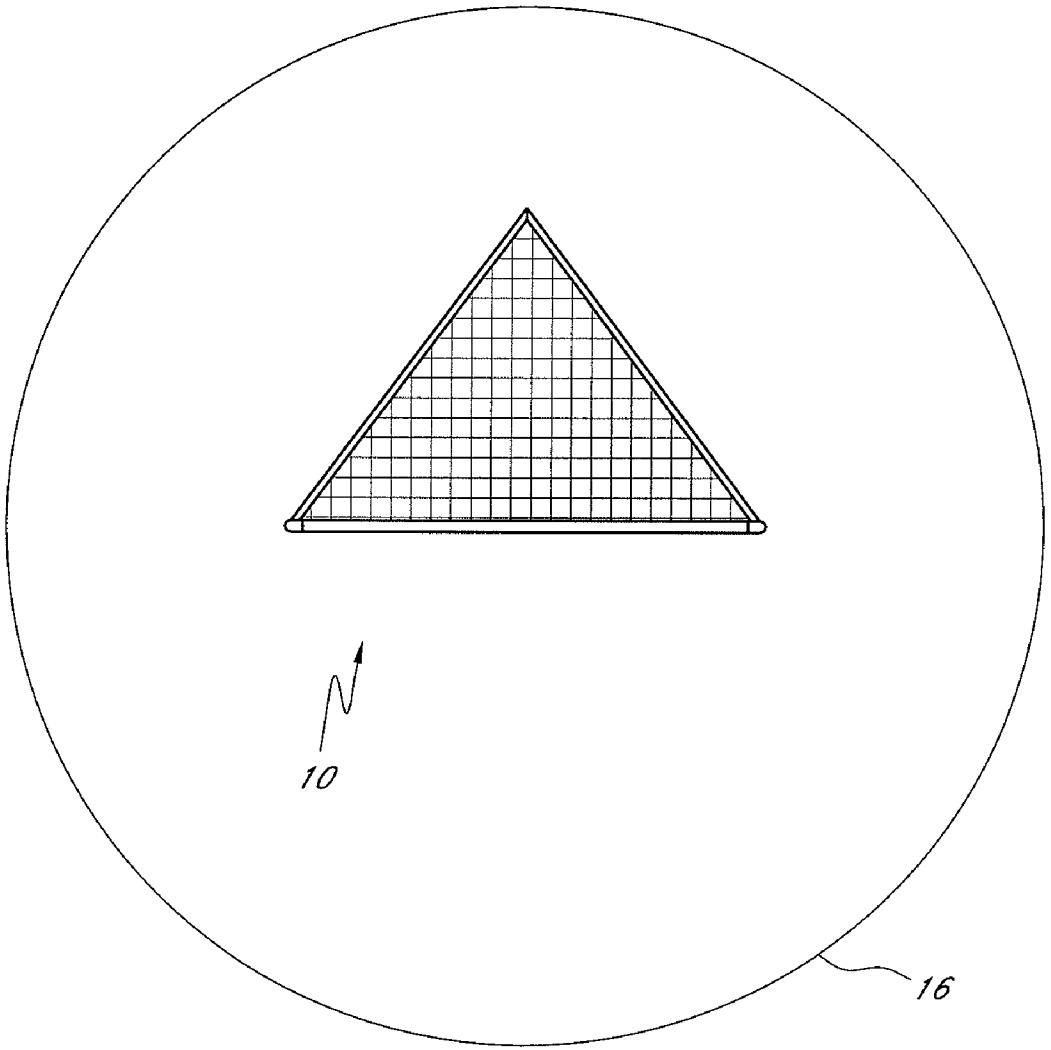
FIG. 1C is a top view of the standard lacrosse goal of FIG. 1A showing its position relative to the "crease."

FIGS. 1A-1C depict front, side, and top views respectively of a typical lacrosse goal 10. The lacrosse goal 10 includes mesh net 14 secured to the goal frame 12. The frame 12 is typically made from tubing or pipe generally having an outer diameter of 1.5". FIG. 1C shows the goal 10 situated in the circular crease 16. Offensive players may not enter into this area during a lacrosse game.

Figure 2:
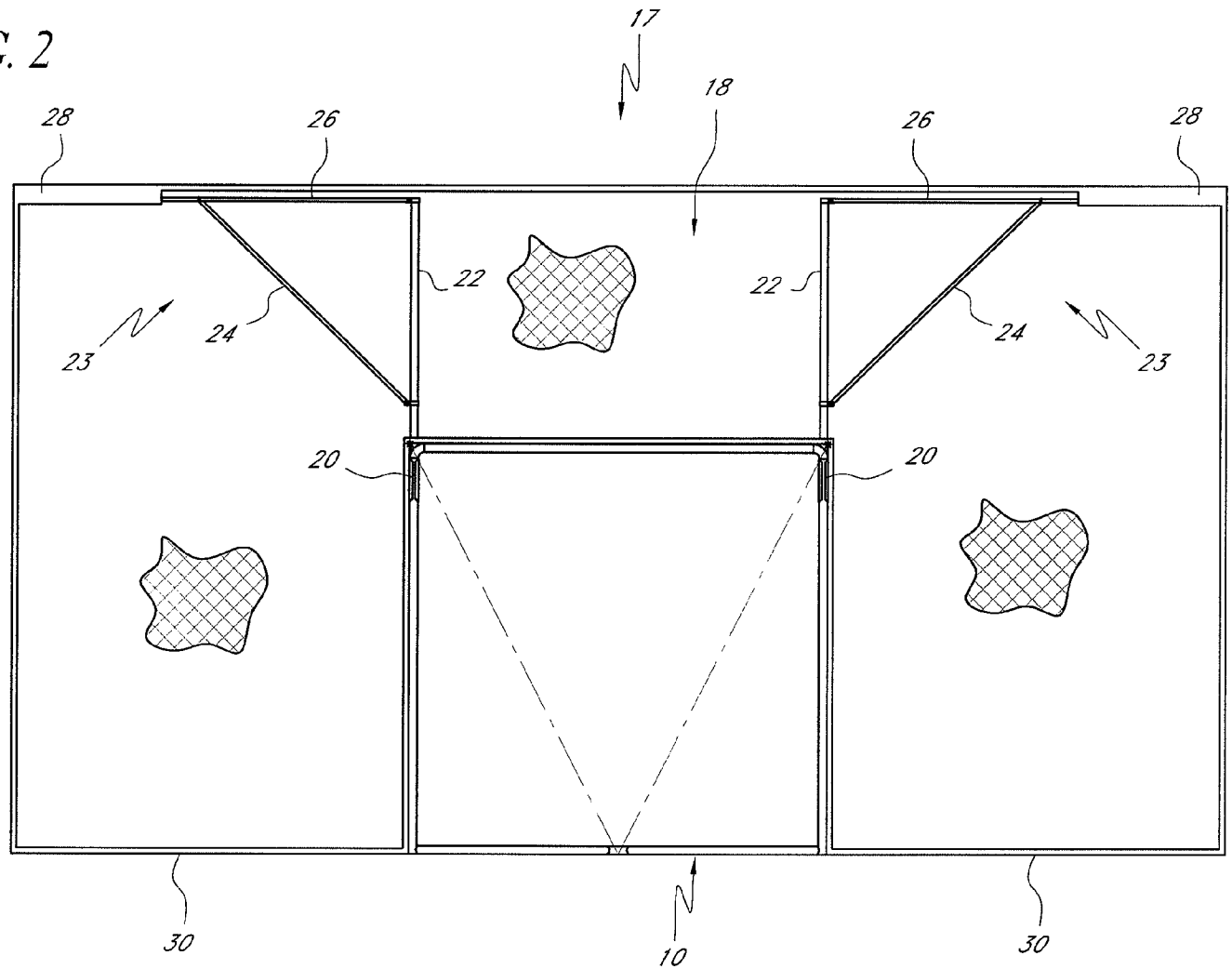
FIG. 2 is a front view of an extension net according to one embodiment of the present invention.

FIG. 2 depicts a front view of an extension net 17 according to one embodiment of the present invention. The extension net 17 includes mesh net 18 which may include standard netting material such as that used to form mesh net 14 of lacrosse goal 10. The mesh net may be made from, for example, nylon. The extension net also includes a frame configured to support the net 18. In the illustrated arrangement, the frame includes two vertical rods 22 which are secured to side posts of the lacrosse goal via mounts 20. Vertical rods 22 are secured to side arms 26 in a cantilevered manner and braced via bracing rods 24 to form left and right triangular frame portions 23. Mesh net 14 includes pockets 28 which slide over a portion of side arms 26 to secure the net to the frame 12. Mesh net 14 may also be secured to the remaining portions of side arms 26, vertical rods 22, and side and top posts of the lacrosse goal 10. Mesh net 14 may be secured using, for example, Velcro straps, ties, clasps, or other suitable attachment means. The bottom portion of mesh net 18 may include weighted portions 30 to facilitate stopping lacrosse shots. Bottom portions may be weighted with lead or other suitable material. Alternatively, the extension net 17 may include canvas bags and appropriate fasteners. A purchaser may fill the canvas bags with, for example, sand and secure the weighted bags to the bottom portion of mesh net 18. In another embodiment, bottom portion of mesh net 18 may be secured to the ground via stakes. Advantageously, such an arrangement may avoid the need to have a frame extend on the bottom and/or sides of the net, thus requiring less material and weight for storing and/or shipping purposes. In certain embodiments, the lower portion of the net may not be weighted at all. In such embodiments, the net itself may provide adequate stopping protection and the lack of weighting may facilitate the net's falling back into position after blocking an errant shot. In certain embodiments, a user may also place a weight on a rear portion of the goal 10 to secure the goal 10 in place and compensate for any top-heaviness contributed by extension net 17.

Figure 3A:
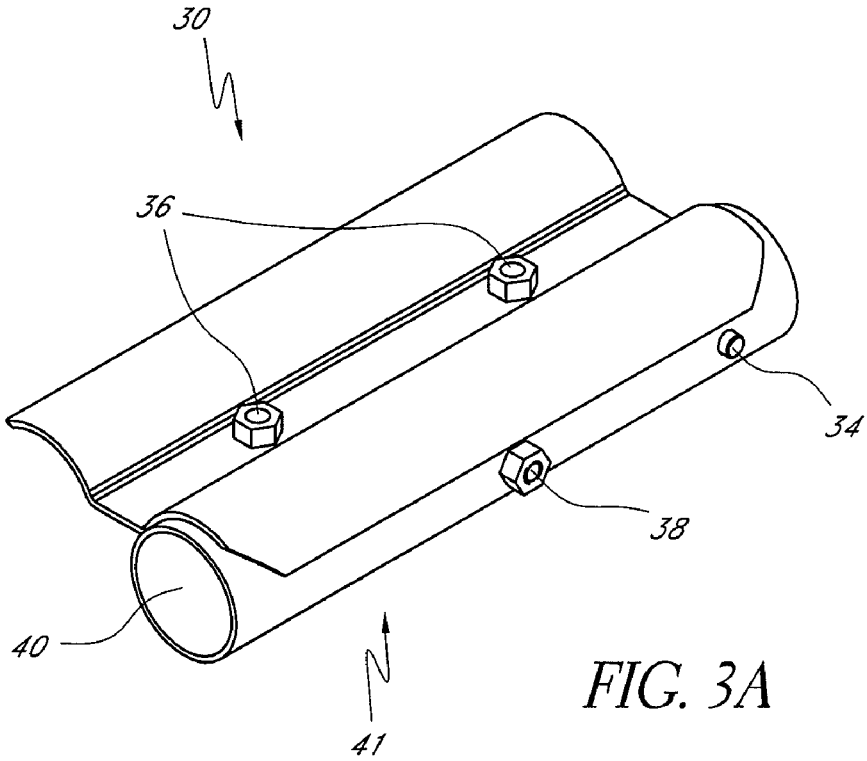
FIG. 3A is a perspective view of a first piece of one embodiment of a mount that can be used to secure an extension net to a lacrosse goal.
Figure 3B:
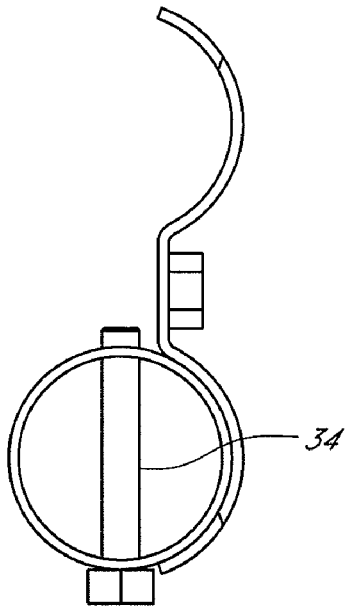
FIG. 3B is a top view of the first piece of FIG. 3A.
Figure 4:
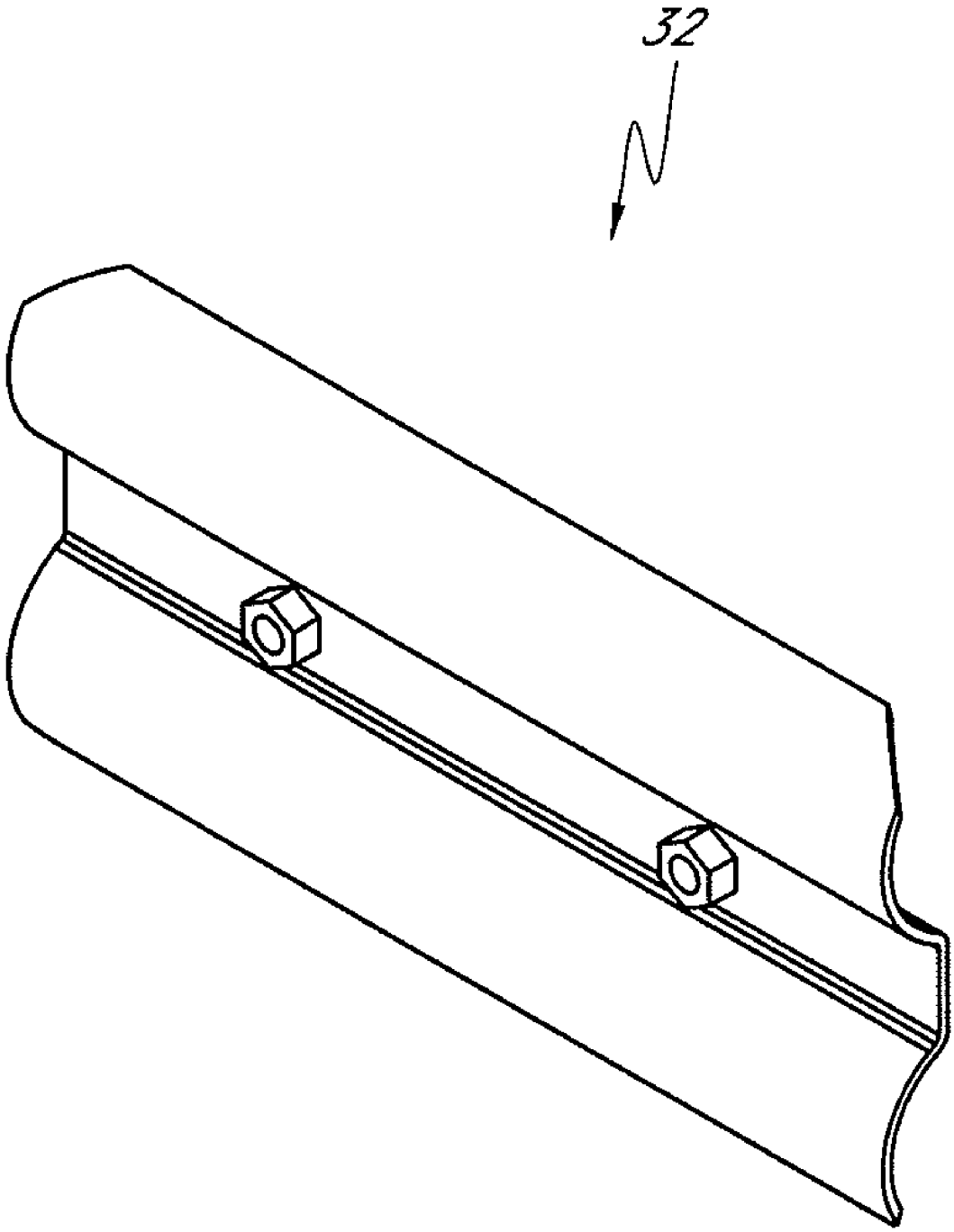
FIG. 4 is a perspective view of a second piece of a mount.

Mounts 20 may include two pieces cooperating together in a clam-shell like fashion. Mounts 20 can include a first piece 30 (shown in FIGS. 3A-3B) and second piece 32 (shown in FIG. 4). First piece 30 and second piece 32 cooperate to clamp each mount 20 to side posts of the lacrosse goal. The mounts 20 are preferably clamped as high as possible on the side posts before the beginning of the posts' curved portions. First and second pieces may be secured to one another and tightened via bolts (not shown). The bolts may be secured to nuts 36 fixedly attached to first piece 30. Each first piece 30 includes a tubular portion 41 with a channel 40 configured to receive an end of vertical rods 22. The lower end of tubular portion 41 may include a welded dowel pin 34 to fix the position of vertical rods 22 at a desired height. Alternatively, tubular portion 41 may include a closed lower end or other appropriate stop means. Mounts 20 also include bolts (not shown) or other appropriate fasteners to secure vertical rods 22 within channel 40. Rods 22 may include openings for receiving one or more bolts, set screws, or the like. Bolts may be secured to nuts 38 which are fixedly attached to each first piece 30.

Figure 9B:
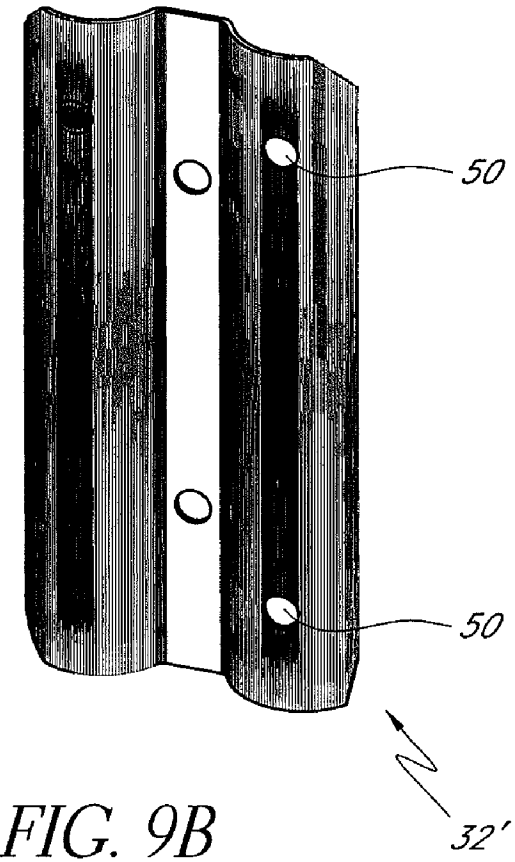
FIG. 9B is a perspective view of another embodiment of a second piece of a mount.
Figure 9A:
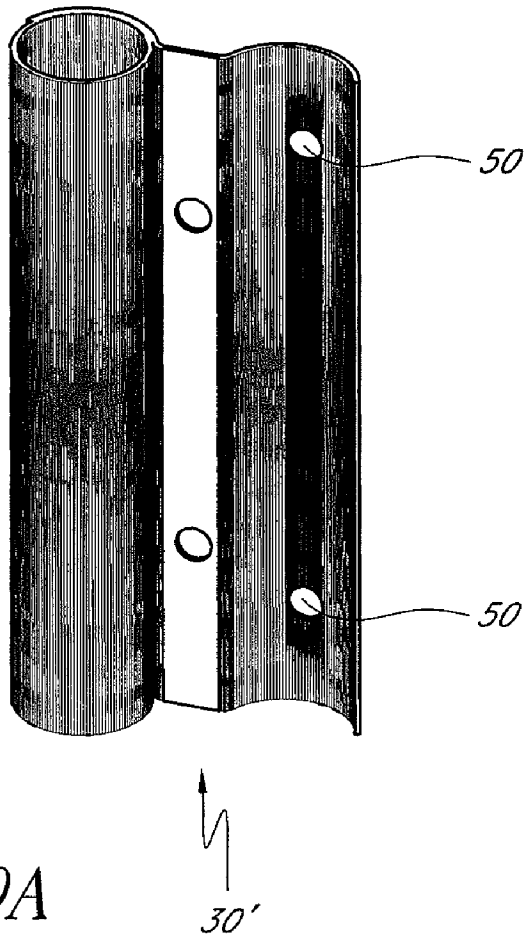
FIG. 9A is a perspective view of another embodiment of a first piece of a mount.

FIGS. 9A and 9B illustrate an alternative embodiment of a clam-shell mounting system including a first piece 30' and second piece 32'. First and second pieces 30' and 32' are similar to first and second pieces 30 and 32. A primary difference is that first and second pieces 30' and 32' include additional pairs of holes 50. Holes 50 are configured to receive bolts to secure the mounts to the lacrosse goal. In certain embodiments, a lacrosse goal is specially manufactured to be compatible with a lacrosse goal extension net. Accordingly, in certain embodiments the left and right posts of the lacrosse frame include one or more holes at an appropriate height which align with holes 50 allowing the extension net to be securely bolted to the goal. In certain embodiments, a user of a lacrosse goal extension net can modify a standard lacrosse goal by drilling holes through the left and right posts in order to facilitate attachment of the lacrosse goal extension net using pieces 30', 32'.

Figure 5:
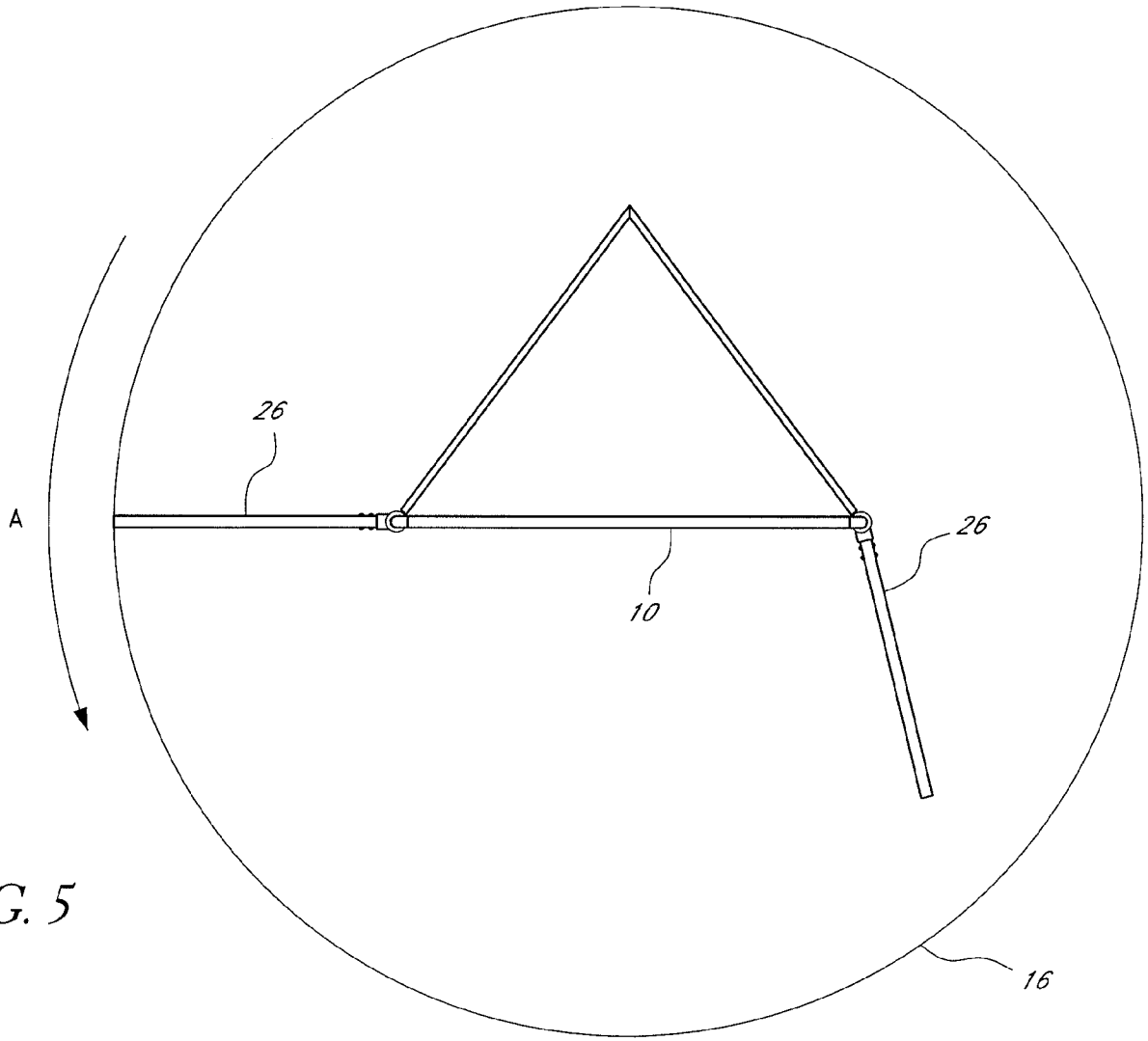
FIG. 5 is a top view of an extension net with one side arm in a position relatively co-planar with the goal and the other side arm in a position relatively perpendicular to the goal.

As shown in FIG. 5, in a preferred embodiment, the extension net is sized to extend from the lacrosse goal to the boundary of the crease. Because a regulation lacrosse goal is 6 feet across and the crease is an 18 foot diameter circle, the left and right side arms 26 of the extension net may extend 6 feet beyond the goal. Such a configuration may facilitate a player's awareness of the crease during practice sessions by marking the crease in settings where the crease is not otherwise marked, e.g. in a typical backyard setup.

In a preferred embodiment, the extension net 17 is configured so that left and right side arms 26 of the net may be adjustably rotated between positions parallel to and/or coplanar with the goal and positions perpendicular to the goal, including intermediate positions. In certain embodiments, only three positions may be possible, a substantially parallel and/or coplanar position, a substantially perpendicular position, and an intermediate position. The ability to rotate side arms 26 is useful for allowing a player to practice shots from a variety of angles by allowing a player to increase the area of missed shot protection. In certain embodiments, the side arms 26 may be rotated by loosening the bolt securing the vertical rods 22 within the mount 20, rotating the vertical rods 22, and then retightening the bolt. In other embodiments, the side arms 26 may be adjustable by rotating a rotatable upper portion of the vertical rods 22. If desired, a detent or other appropriate mechanism can be provided to secure the side arms 26 in one of a number of available positions.

FIG. 5 depicts a top view of an extension net 17 where the right side arm 26 has been adjusted to a position nearly perpendicular to the goal 10. The left side arm 26 remains in a standard position substantially co-planar with the goal 10. A player may use this configuration to practice the following shooting drill. The player begins by swinging around from behind the left side of the goal 10. The player's motion is illustrated by arrow A. The presence of the left side arm 26 forces the player to maintain a distance from the goal 10 that would be outside of the crease 16 in a regulation game. The player then takes a side shot at the goal. The right and left side arm are beneficially positioned to maximize the missed shot protection for a shot taken from this angle. Other configurations and drills will be apparent to one of ordinary skill in the art.

Other additional configurations may be possible according to certain embodiments of a lacrosse goal extension net. For example, in certain embodiments, the left and right side arms may be independently adjustable to one or more of the following positions: approximately 90 degrees behind the goal, approximately 60 degrees behind the goal, approximately 45 degrees behind the goal, approximately 30 degrees behind the goal, substantially parallel to and/or co-planar with the goal, approximately 30 degrees in front of the goal, approximately 45 degrees in front of the goal, approximately 60 degrees in front of the goal, and approximately 90 degrees in front of the goal. In certain embodiments, the left and right side arms may be adjustable to one or more intermediate positions between the positions set forth above. In certain embodiments, the left and right side arms may be adjustable to all intermediate positions.

Figure 6:
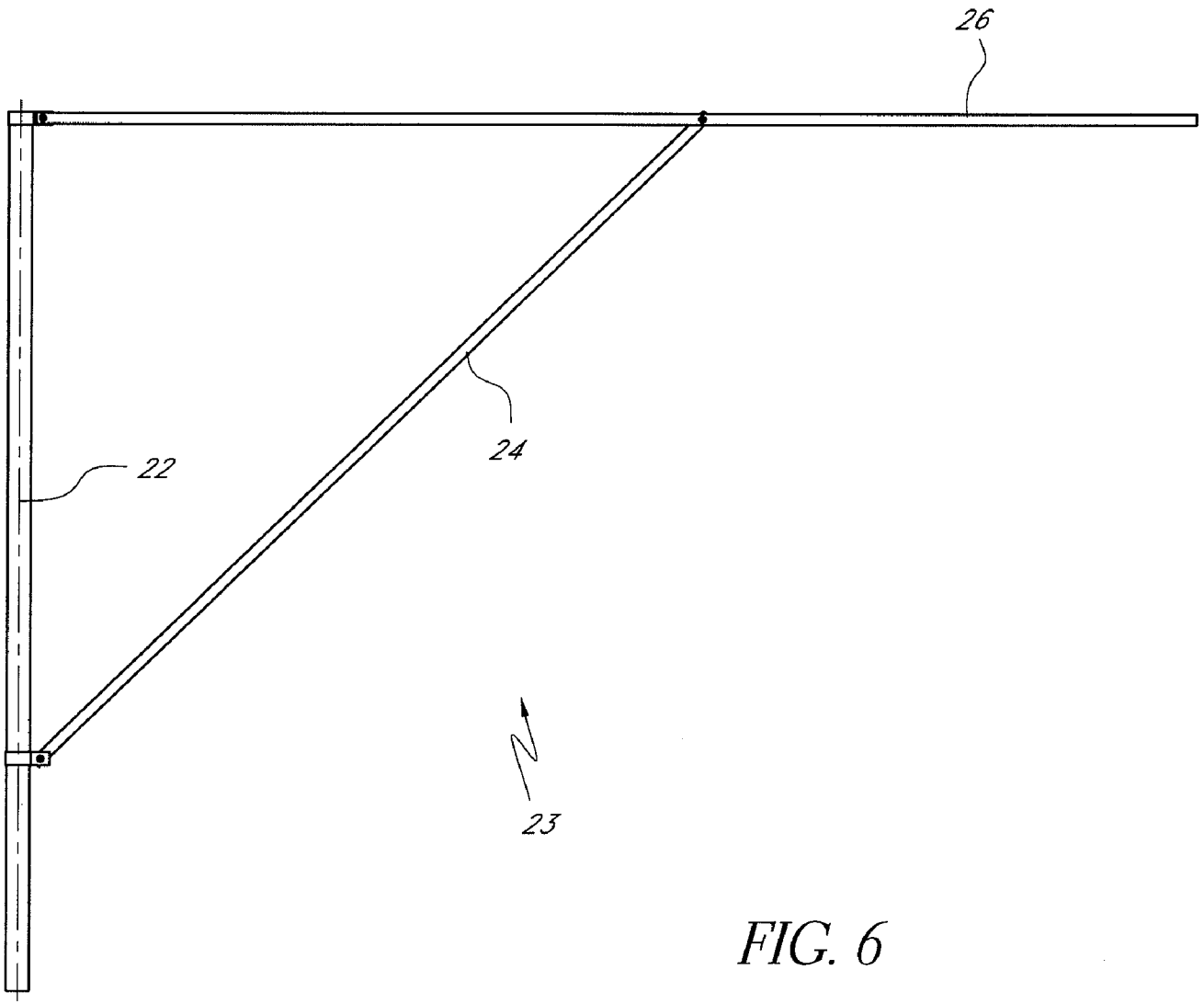
FIG. 6 is a front view of a side frame portion.

FIG. 6 illustrates the three pieces used to form each side of the frame for the extension net in one embodiment, i.e. the side arm 26, vertical rod 22, and bracing rod 24 which may be secured to one another by bolts or other suitable fastening mechanisms. The frame may extend along part or all of the net's upper edge. As illustrated, frame portions 23 include only three pieces. Alternatively, frame portions 23 may be integrally formed, include members additional to those shown, or have alterative geometries. In a preferred embodiment, the frame extends along only a portion of the periphery of the extension net. The use of frame portions 23 advantageously minimizes the weight and bulkiness of the extension net 17 while preserving adequate support for mesh net 18. The described embodiment also enables a user to quickly and easily set up and remove the extension net 17. Once the initial set up is complete, a user need only remove the vertical rods 22 from the mounts 20 (or alternatively remove the mounts from the side posts) and remove the Velcro straps or other fasteners securing the mesh net 18 to the goal 10. The extension net 17 can thus remain in one piece and ready for quick reinstallation.

In certain embodiments, the extension net may be configured to fold behind the goal when not in use, e.g., during a scrimmage game. Left and right side arms may fold backwards behind the goal so as to be out of the way. The top of the extension net may also be configured to fold down so as to enable a ball to pass over the top of the goal 10. This may be accomplished, for example, by the placement of a pivot in vertical rods 22.

Figure 7:
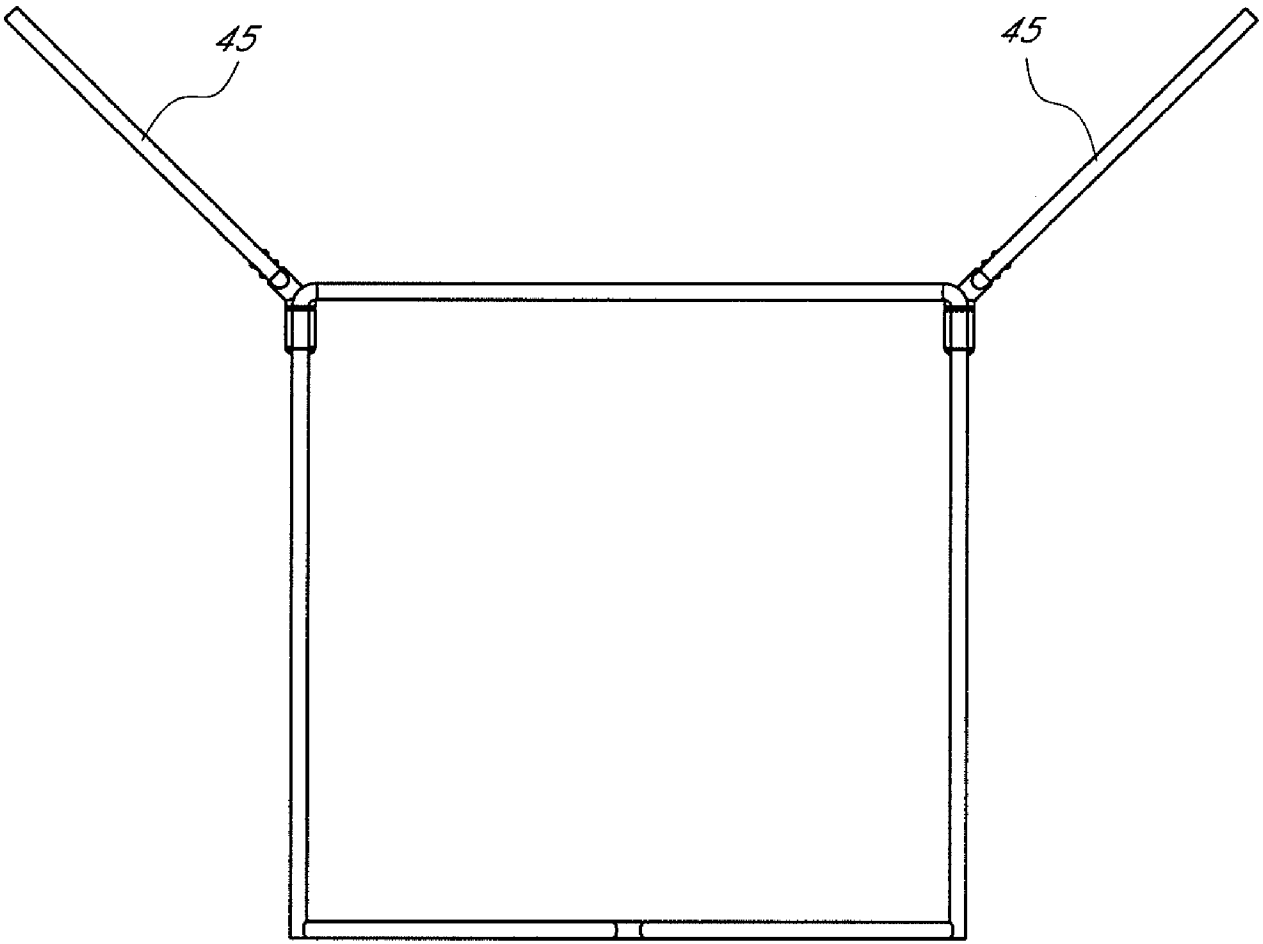
FIG. 7 is a front view of an extension net according to another embodiment.
Figure 8:
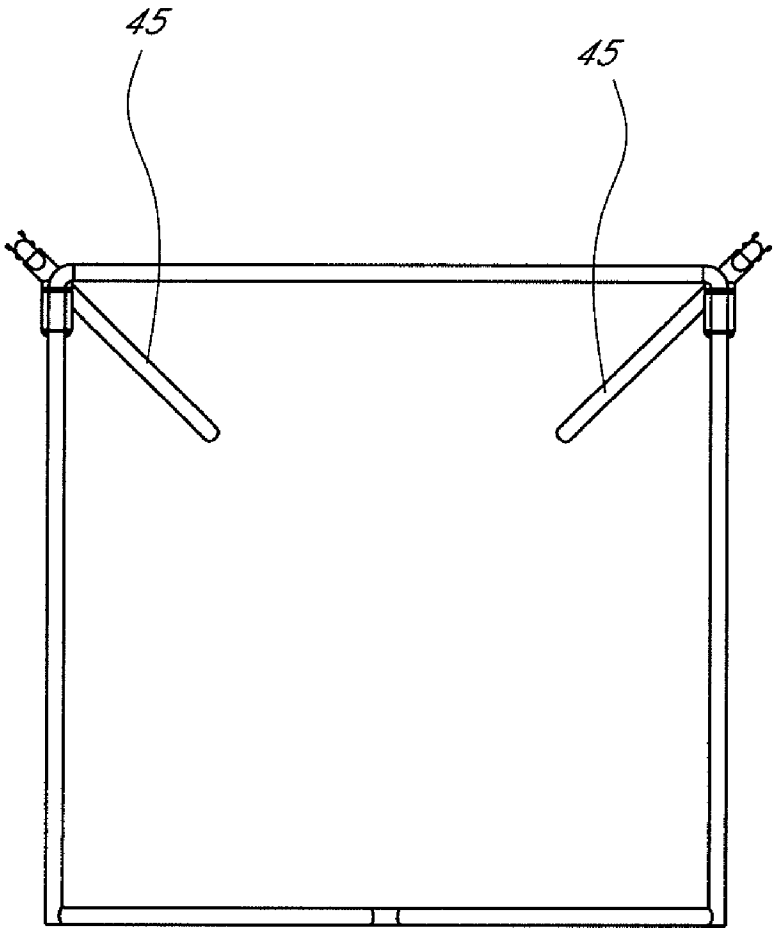
FIG. 8 is a front view of the extension net of FIG. 7 where the frame rods have been folded back behind the goal.

FIGS. 7-8 illustrate an alternative embodiment of an extension net. Triangular frame portions 23 have been replaced by individual frame rods 45 extending diagonally from mounts attached to left and right side posts of the goal. A mesh net which may be similar to that of mesh net 18 may then be secured to frame rods 45 and to top and side posts of the goal via a variety of fasteners. Frame rods may be configured to pivot behind the goal when the extension net is not in use as seen in FIG. 8. In certain embodiments, a third frame rod may be secured to the top post of the goal to provide additional support for the mesh net or extend between diagonal frame rods 45.

Figure 10:
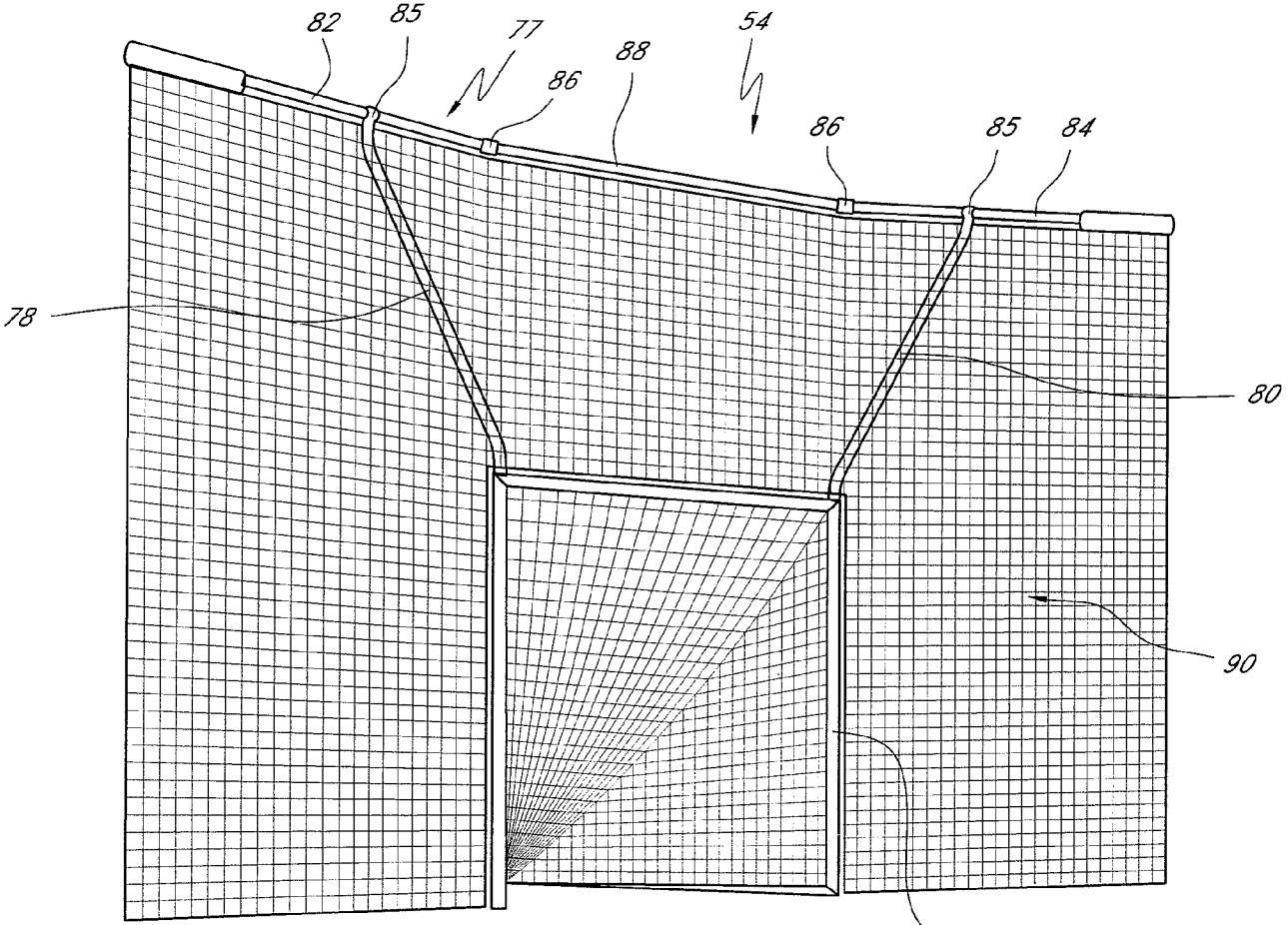
FIG. 10 is a perspective view of another embodiment of a lacrosse goal and lacrosse goal extension net.
Figure 11:
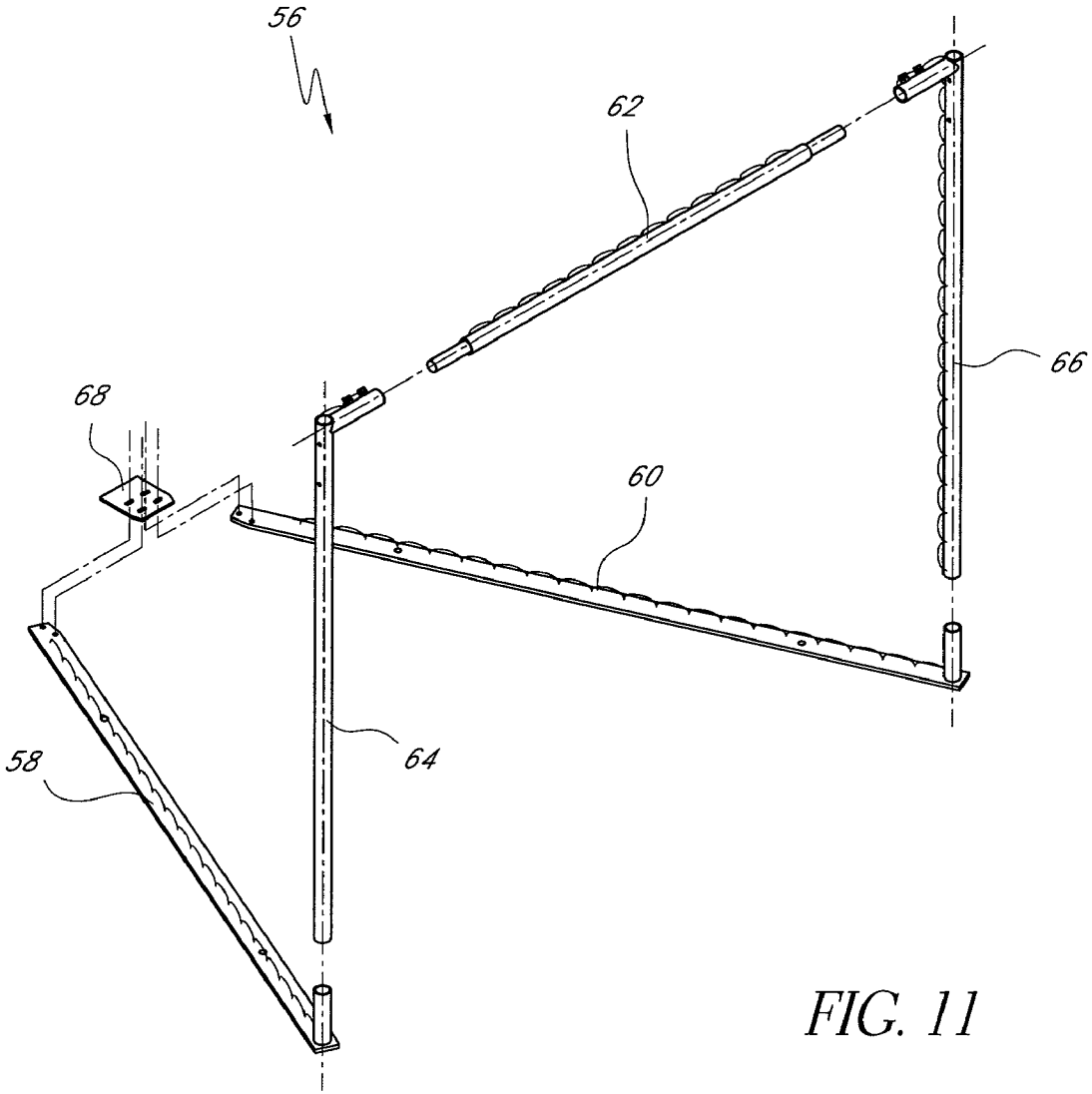
FIG. 11 is an exploded view of a frame portion of the lacrosse goal of FIG. 10.
Figure 12A:
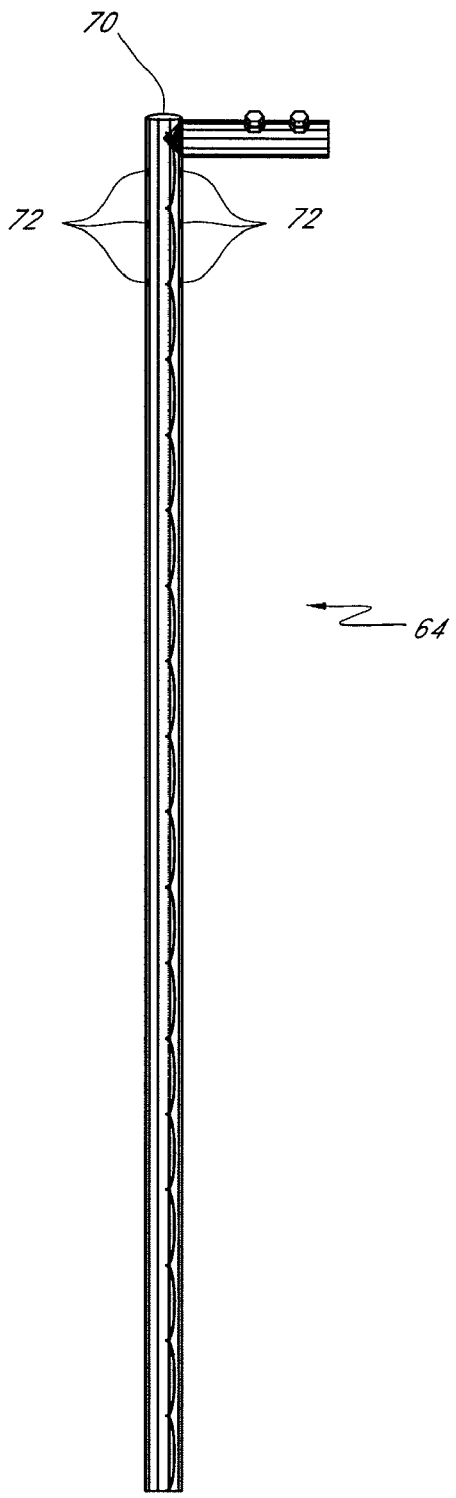
FIG. 12A is a front view of a left goal upright of the frame portion of FIG. 11.
Figure 12B:
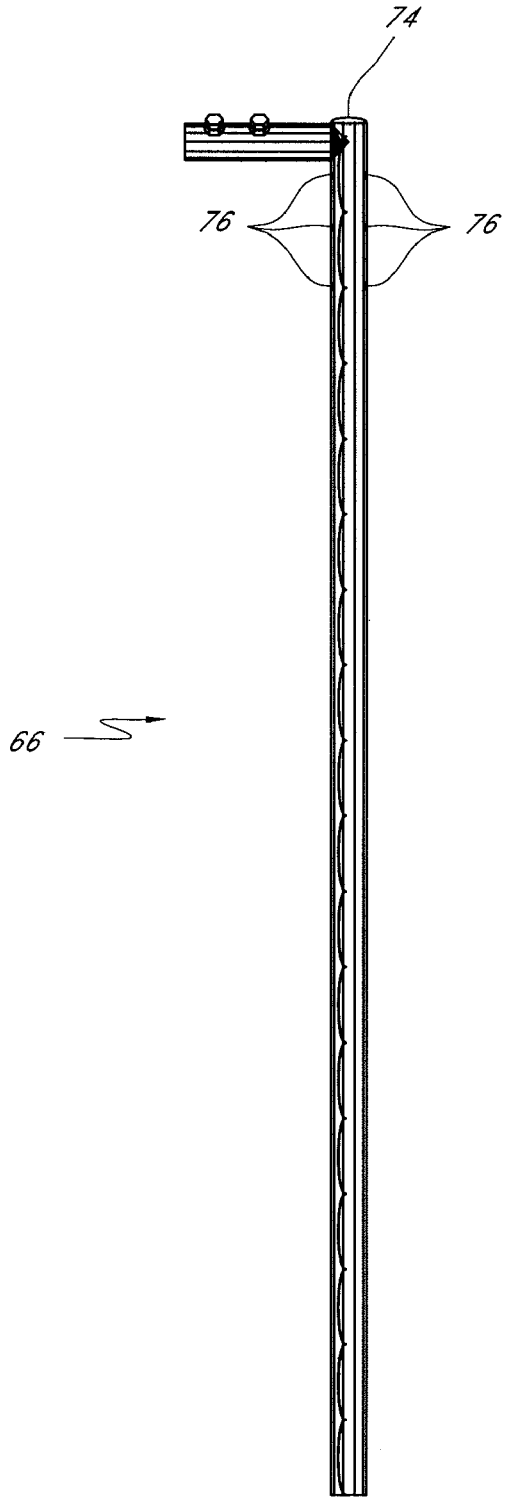
FIG. 12B is a front view of a right goal upright of the frame portion of FIG. 11.

FIG. 10 illustrates another embodiment of a lacrosse goal extension net 54. Lacrosse goal extension net 54 can be configured to attach to a standard lacrosse goal using appropriate mounts such as mounts 20. In the illustrated embodiment, lacrosse goal extension net 54 is configured to cooperate with a specially adapted lacrosse goal 52. Lacrosse goal 52 can be similar to a standard lacrosse goal but is specially adapted to receive extension net 54. FIG. 11 illustrates the assembly of the frame 56 of lacrosse goal 52. Lacrosse goal frame 56 includes left and right legs 58, 60 which are bolted together in the rear of the goal via back plate 68. Left and right legs receive, respectively, left and right goal uprights 64, 66. Left and right goal uprights are connected by center crossbar 62.

Left and right goal uprights include openings 70, 74 configured to receive, respectively, net support uprights 78, 80 of the extension net frame 77. Left and right goal uprights also include pairs of holes 72 and 76 configured to receive pins for adjusting the angle of the extension net's left and right portions.

Figure 13:
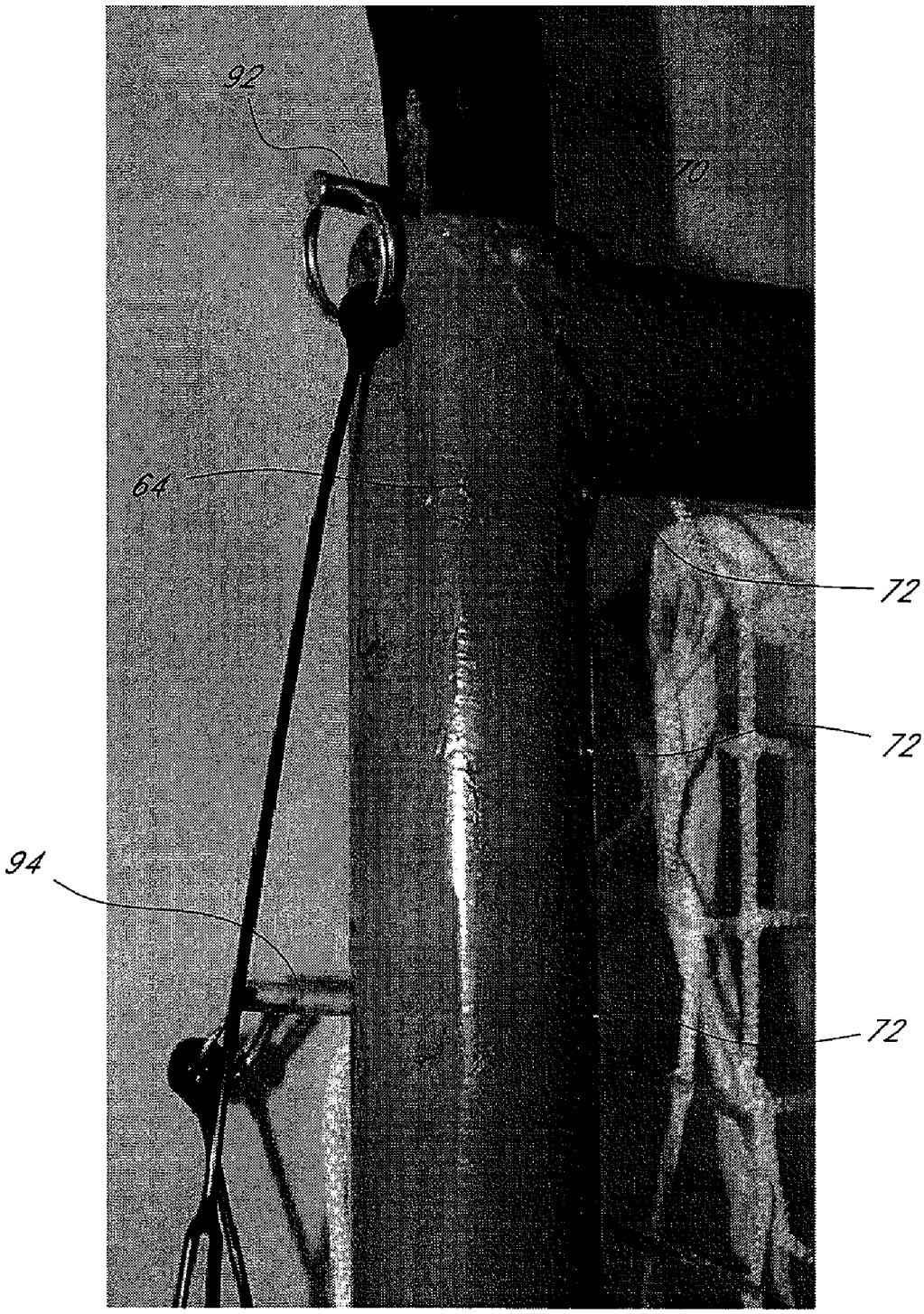
FIG. 13 is a close-up view of the left upright net support secured within the left goal upright.
Figure 14:
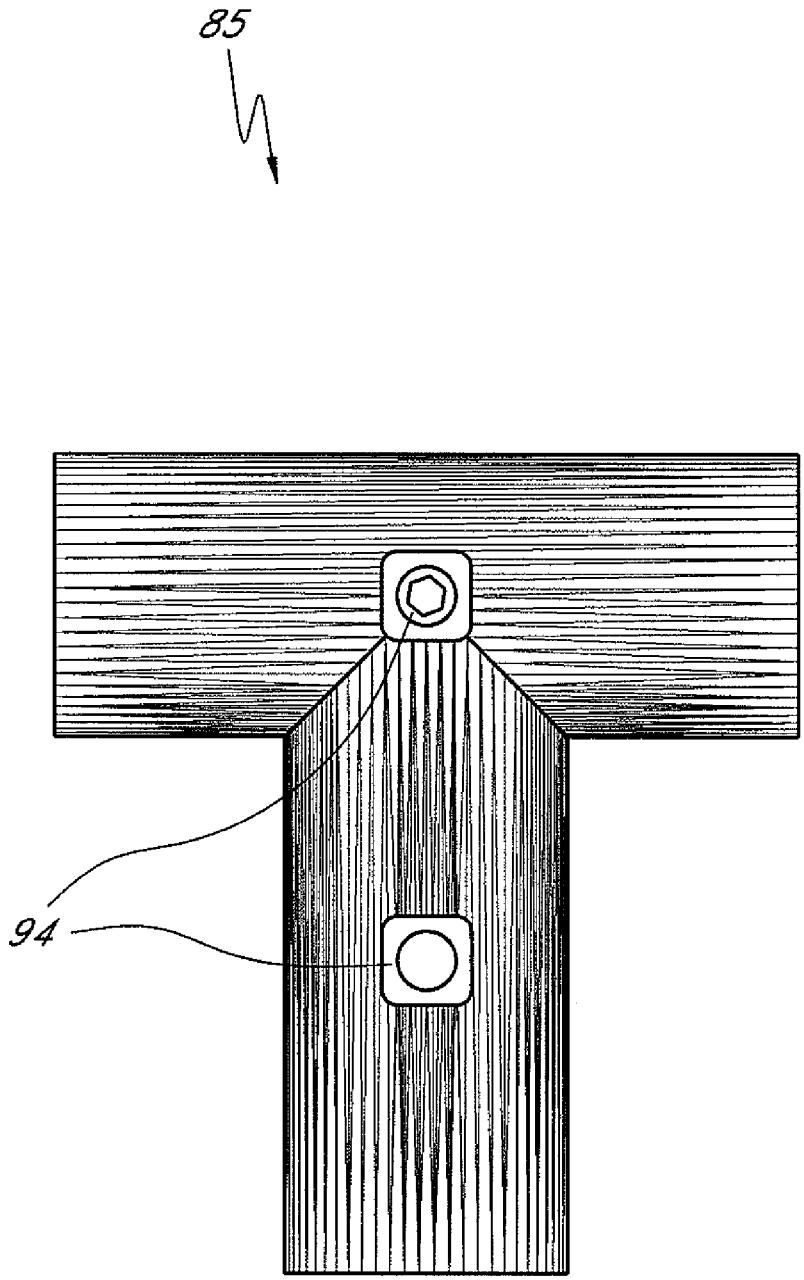
FIG. 14 is a front view of a tee joint.
Figure 15:
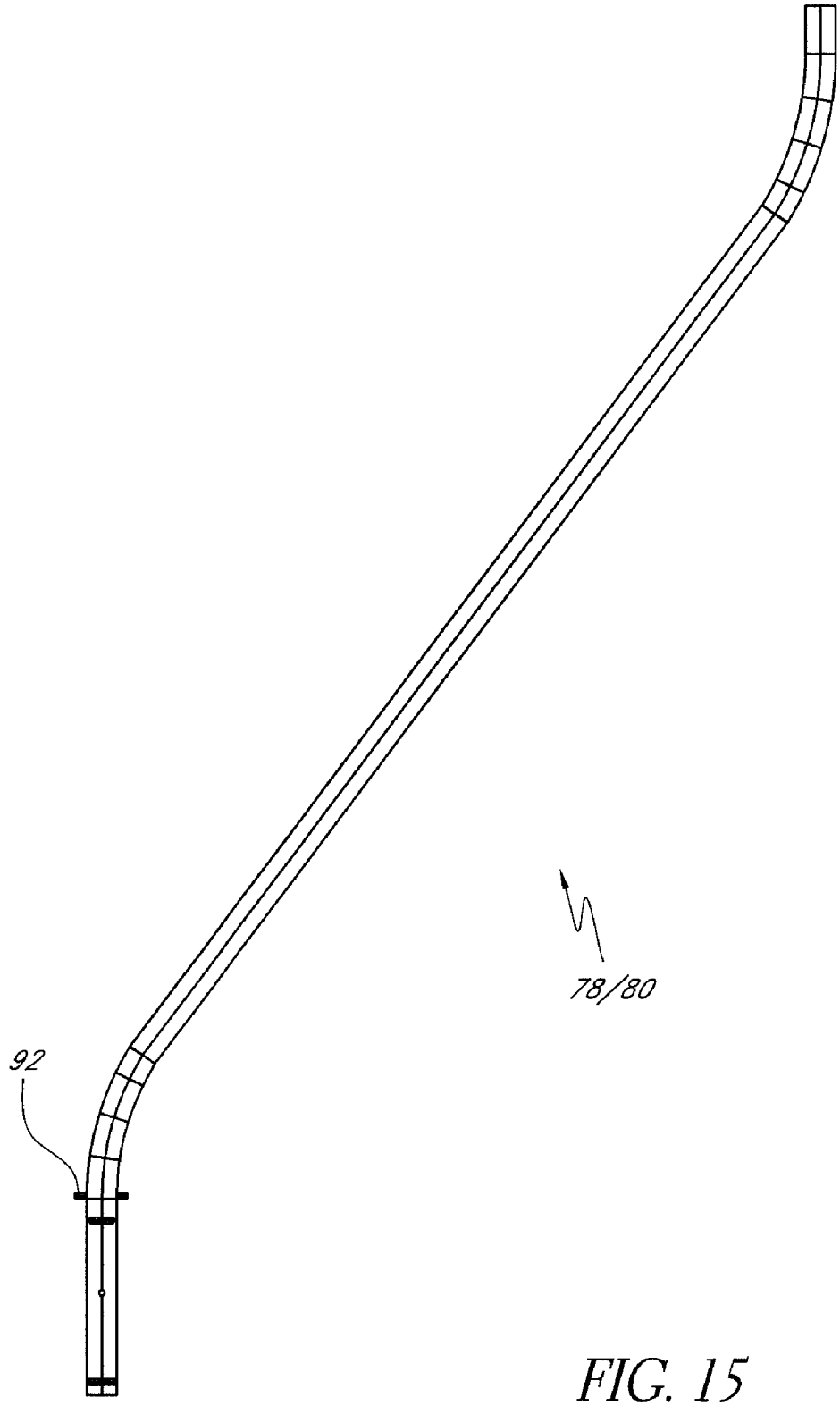
FIG. 15 is a front view of the left or right upright net support of the lacrosse goal extension net of FIG. 10.
Figure 16:
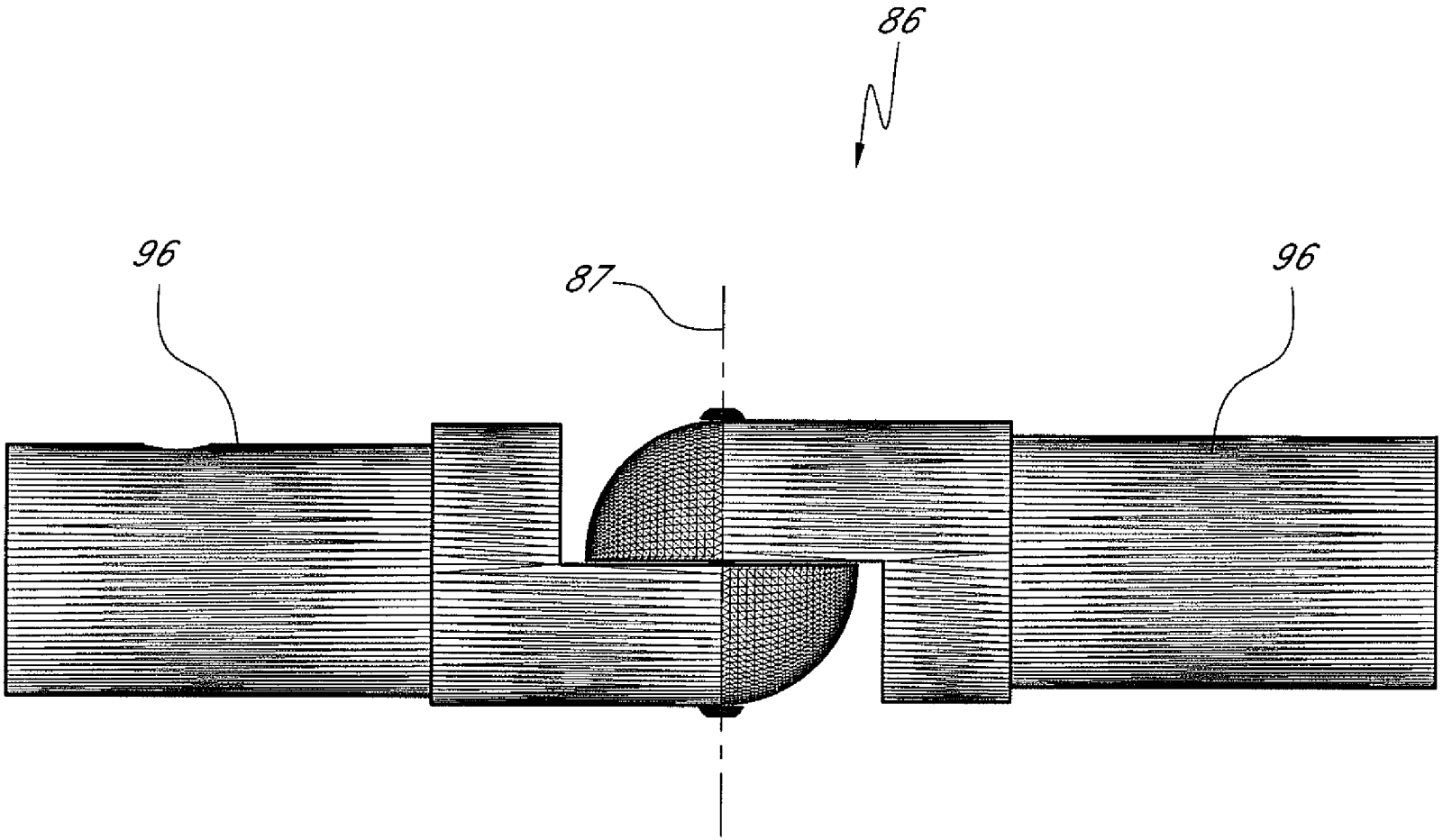
FIG. 16 is a front view of an articulated elbow joint of the lacrosse goal extension net of FIG. 10.
Figure 17:
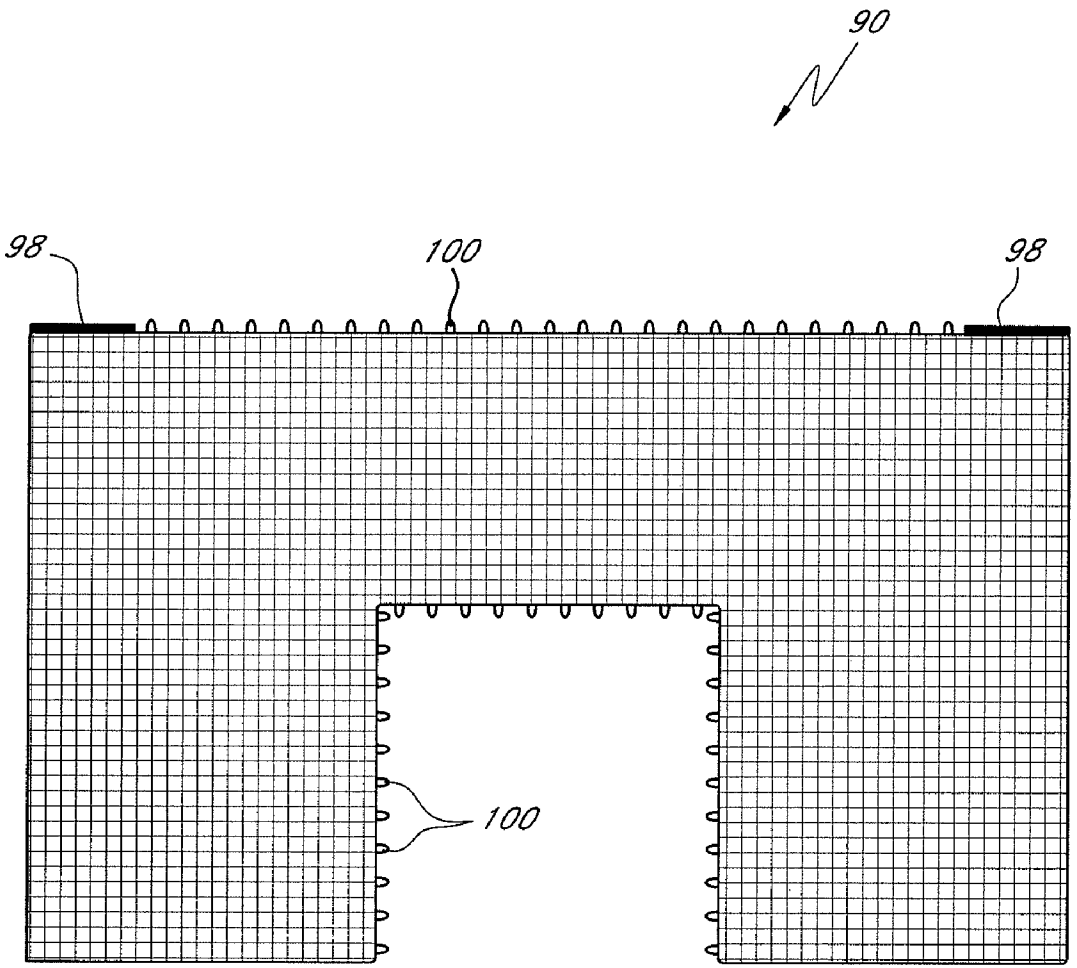
FIG. 17 is a front view of the net of the lacrosse goal extension net of FIG. 10.

Extension net 54 includes frame 77 and net 90. Frame 77 includes left and right upright supports 78, 80. As described above, the lower ends of net support uprights 78, 80 are received within openings 70, 74. In certain embodiments, the lower ends of net support uprights 78, 80 include a pin 92 (FIG. 13) which prevents the supports from being inserted beyond the desired depth. In certain embodiments pin 92 is a permanent pin. In other embodiments, pin 92 is removable. Alternatively, the lower ends of the net support uprights can include an upper enlarged diameter portion which acts as a stop to prevent overinsertion of the net support uprights into the goal uprights. In certain embodiments, openings 70, 74 may only extend to the desired depth of insertion and/or include a permanent or removable pin positioned at a desired depth.

In certain embodiments, lower ends of net support uprights 78, 80 include one or more pairs of holes configured to receive an adjustment pin 94. The pairs of holes can be oriented at different angles in order to permit the angle of the extension net's side portions to be adjusted. In order to adjust the extension net, the net support uprights are rotated until the holes of the support uprights align with one of the hole pairs 72, 76 of the left and right goal uprights. In certain embodiments, each of the hole pairs 72, 76 can be oriented at the same angle as shown in the Figures. Adjustment pins 94 are then inserted to hold the side arms in position. In the illustrated embodiment, the angled hole pairs are positioned at different heights in order to preserve the structural integrity of the net support uprights and goal uprights. In certain embodiments the side portions of the extension net may be rotatable without being secured or may secured by another method such as for example, one or more set screws.

In certain embodiments, a first pair of holes may be used to adjust the arms to a position that is substantially parallel to and/or substantially co-planar with the face of the lacrosse goal. A second pair of holes may be used to allow the side arms to be adjusted to a position that is substantially perpendicular and in front of the goal. A third pair of holes may be used to allow the side arms to be adjusted to a position that is substantially perpendicular and to the rear of the goal. A fourth pair of holes may be used to allow the side arms to be adjusted to a position that is about 45 degrees in front of the goal. A fifth pair of holes may be used to allow the side arms to be adjusted to a position that is about 45 degrees behind the goal. In certain embodiments, additional or different hole pairs can be used to achieve different orientations.

The upright net supports 78, 80 connect to, respectively, left and right side arms 82, 84 via tee joints 85. Tee joints 85 include holes 94 allowing the tee joints 86 to be bolted to the left and right side arms 82, 84 and to the left and right upright supports 78, 80. In the illustrated embodiment, tee joints 85 are located in an intermediate or a medial position of arms 82, 84 spaced from the ends of the side arms 82, 84. In certain embodiments, the tee joints 85 are located in the approximate center of side arms 82, 84. The central portions of left and right upright net supports are curved outward in order to allow the supports to connect to the tee joints 85. It has been found that this configuration provides greater support for side arms 82, 84. In certain embodiments upright supports extend outward approximately ⅓ the length of side arms. In certain embodiments upright supports extend outward approximately ½ the length of side arms.

Figure 18:
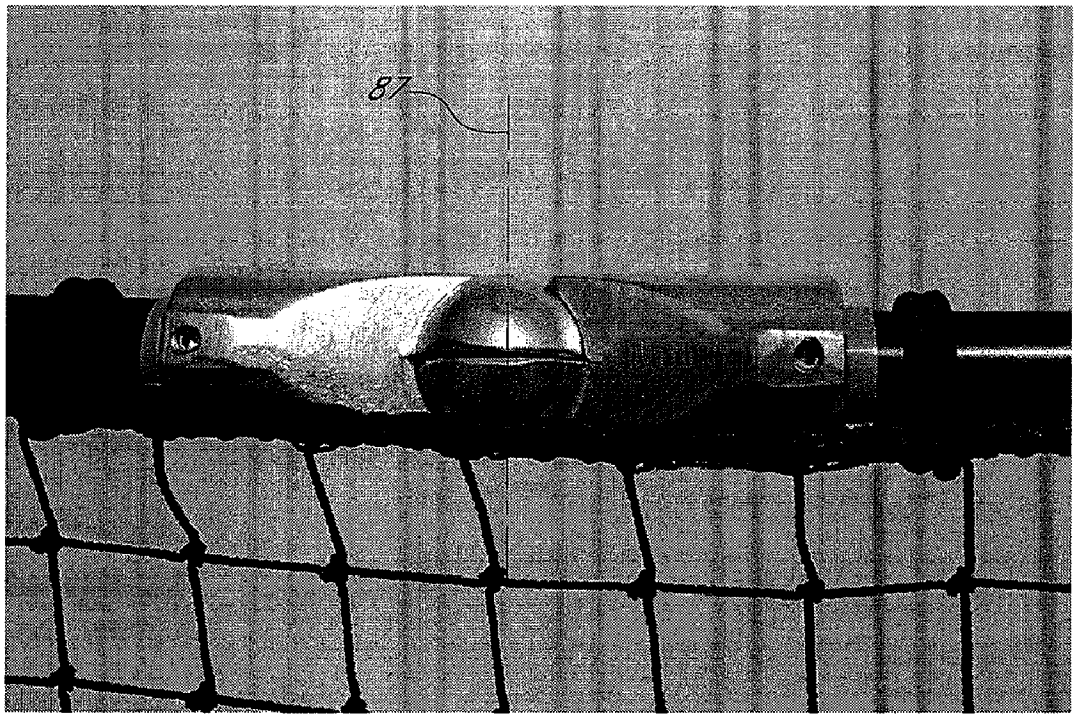
FIG. 18 is a front view of another embodiment of an elbow joint.

Side arms 82 and 84 connect to center bar 88 via articulated elbow joints 86. Elbow joints 86 allow the side arms 82, 84 to rotate around a vertical axis passing through joints 86, permitting the side portions of the extension net to be adjustably configured. Elbow joints 86 include ends 96 which are received within openings on the ends of center bar 88 and side arms 82, 84. Center bar 88 and side arms 82, 84 are bolted to or otherwise secured to elbow joints 86. FIG. 18 illustrates an alternative embodiment of an elbow joint 86'. Elbow joint 86' is an external joint and includes openings configured to receive the ends of center bar 88 and side arms 82, 84. The elbow axes 87 of elbow joints 86 and 86' are aligned with the rotation axis of net support uprights 78, 80.

The top of extension net 90 can include pockets 98 on opposite corners. Pockets 98 are configured to receive ends of side arms. Net 90 can also include ties, Velcro straps, "bungie ball" connectors, or other suitable connectors 100 for securing the net 90 to additional portions of frame 77. Such connectors 100 are also used to secure the net 90 to the left and right goal uprights and to the goal's center crossbar.

Figure 19A:
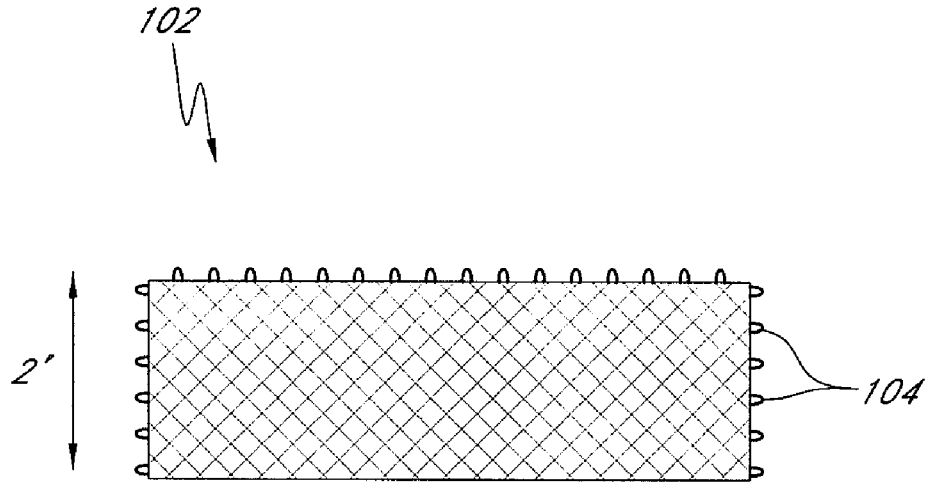
FIG. 19A is a front view of a hockey attachment net according to one embodiment of the present invention.
Figure 19B:
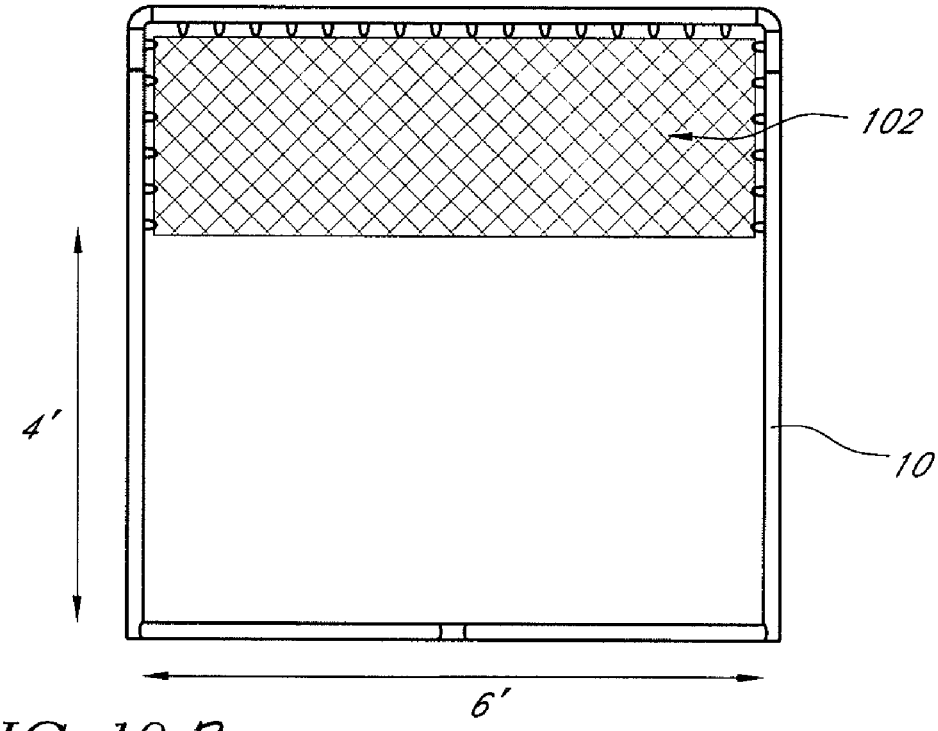
FIG. 19B is a front view of the hockey attachment net of FIG. 19A secured to a standard lacrosse goal.

A hockey attachment net 102 is shown in FIG. 19A. A standard lacrosse goal measures 6 feet high and 6 feet wide. A standard hockey goal measures 6 feet wide and 4 feet high. Many athletes play both of these sports. The hockey attachment net 102 includes a piece of netting that is sized approximately 2 feet by 6 feet. The hockey attachment net 102 includes connectors 104 on the top and sides of the attachment net. Connectors 104 can include ties, Velcro straps, "bungie-ball" connectors or other suitable connecting means. The hockey attachment net 102 attaches to the upper portion of a standard lacrosse goal 10 as shown in FIG. 19B to shrink the effective shooting area of the goal to hockey dimensions. The hockey attachment net 102 can be utilized alone or in combination with the extension net 54. Attachment nets of other dimensions can be utilized with other types of goals, e.g. soccer or hockey goals, in order to reduce the shooting area to the desired dimensions. The use of an extension net that clamps or otherwise attaches directly to the frame of an existing lacrosse goal provides numerous advantages when compared to other backstops. By utilizing the lacrosse goal for its support, the need for additional structure is minimized, thus reducing size, weight, and overall expense. Additionally, the extension net may be made smaller than other backstops because of its close proximity to the goal. Lacrosse shots frequently arc upwards. Thus, a shot that overshoots the goal by a small amount may continue to rise and ultimately reach a significant height. The proximity of the extension net to the goal thus allows the extension net to capture more missed shots that are "on the rise", reducing the need for a very tall backstop. Assembly of the extension net may be accomplished by placing the goal front face down, assembling rods and clamps and attaching them to the goal, securing the net to the frame and goal, and then replacing the goal right side up. Other assembly methods are also possible.

While the invention has been described with reference to a lacrosse goal, other embodiments are possible, including without limitation, extension nets coupled to hockey goals, soccer goals or any other suitable type of sports goal. Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present lacrosse goal extension net and extension net and goal system have been described in the context of particularly preferred embodiments, the skilled artisan will appreciate, in view of the present disclosure, that certain advantages, features and aspects of the extension net and/or system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A lacrosse goal and extension net comprising:

a lacrosse goal comprising first and second upright frame posts and a horizontal frame member extending between upper end portions of said first and second upright frame posts;

an extension frame including left and right frame portions, each having a lowermost end portion configured to attach to upper end portions of a respective one of said left and right upright frame posts of said lacrosse goal and be supported thereby in a cantilevered manner, each of said left and right frame portions extending upward from said respective lowermost end portions and having horizontal members extending outward from said upright frame posts of said lacrosse goal; and a one-piece mesh net supported by said frame and having a left side portion supported at an upper end by said horizontal member of said left frame portion, a right side portion supported at an upper end by said horizontal member of said right frame portion, and a center portion between said right and left side portions, wherein at least a substantial length of right and left side edges and right and left bottom edges of said mesh net are not supported by said frame;

wherein each of said left and right frame portions are rotatably adjustable about a respective axis of said left and right upright frame posts to vary an angle between said left and right frame portions and said lacrosse goal.

2. The goal and extension net of claim 1, wherein said net is secured at least to said left and right horizontal members.

3. The goal and extension net of claim 2, wherein said lacrosse goal is specially adapted to receive said extension net, said left and right frame posts each defining an opening configured to receive a respective one of said left and right frame portions.

4. The goal and extension net of claim 2, wherein said net includes left and right pockets in upper corners of said net, said left pocket configured to receive an end of said left horizontal member and said right pocket configured to receive an end of said right horizontal member.

5. The goal and extension net of claim 2, wherein said left and right frame portions are infinitely adjustable in angular orientation relative to said lacrosse goal.

6. The goal and extension net of claim 2, wherein said left and right frame portions are adjustable to a limited number of configurations in angular orientation relative to said lacrosse goal.

7. The goal and extension net of claim 6, wherein each of said left and right frame portions define a plurality of adjustment pin hole pairs, each of said adjustable pin hole pairs defining a different angular orientation of one of said left and right frame portions.

8. The goal and extension net of claim 2, wherein said frame does not extend substantially along the sides or bottom of said net.

9. The goal and extension net of claim 1, further comprising at least one weighted member that can be applied to a lower end of said mesh net.

10. The goal and extension net of claim 9, wherein said at least one weighted member comprises a first weighted member and a second weighted member, wherein said first weighted member can be applied to said first side portion of said mesh net and said second weighted member can be applied to said second side portion of said mesh net.

11. The goal and extension net of claim 10, wherein said first and second weighted members are integrated with said mesh net.

12. The goal and extension net of claim 1, additionally comprising a left mount and a right mount configured to be secured to said left and right frame posts of said lacrosse goal, said left mount configured to support said left frame portion and said right mount configured to support said right frame portion.

13. The goal and extension net of claim 12, wherein said left frame portion comprises a left upright support member and said right frame portion comprises a right upright support member, and wherein each of said left and right mounts comprises first and second pieces which fit together in a clam-shell like fashion around said left and right frame posts, each of said left and right mounts defining an opening configured to receive an end of a respective one of said left and right upright support members.

14. The goal and extension net of claim 1, wherein a width of said mesh net is 18 feet.

* * * * *